US011666097B2

(12) United States Patent
Liu

(10) Patent No.: US 11,666,097 B2
(45) **Date of Patent: *Jun. 6, 2023**

(54) ELECTRONIC CIGARETTE

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 398 days.

This patent is subject to a terminal disclaimer.

(21) Appl. No.: 16/930,347

(22) Filed: Jul. 16, 2020

(65) Prior Publication Data

US 2022/0015432 A1 Jan. 20, 2022

(51) Int. Cl.

| | |
|---|---|
| ***A24F 40/48*** | (2020.01) |
| ***A24F 40/10*** | (2020.01) |
| ***A24F 40/95*** | (2020.01) |

(52) U.S. Cl.

CPC ..... *A24F 40/48* (2020.01); *A24F 40/10* (2020.01); *A24F 40/95* (2020.01)

(58) Field of Classification Search

CPC ..... A24F 40/48; A24F 40/10; A24F 40/95; A24F 47/00; A24F 40/40; A61M 15/06; A61M 11/00

See application file for complete search history.

(56) References Cited

U.S. PATENT DOCUMENTS 10,334,887 B1 * 7/2019 Qiu ..... A24F 40/49
2015/0128970 A1 * 5/2015 Liu ..... A24F 40/485 131/329

FOREIGN PATENT DOCUMENTS

CN 207653564 U * 7/2018 ..... A24F 40/485

OTHER PUBLICATIONS

Liu, Qiu-ming et al., "Electronic Cigarette" (EPO Patent Translate, machine translation) (Year: 2018).*

* cited by examiner

*Primary Examiner* — Kelly M Gambetta
*Assistant Examiner* — Katherine A Will
(74) *Attorney, Agent, or Firm* — Matthias Scholl P.C.; Matthias Scholl

(57) ABSTRACT

An electronic cigarette including a condensate absorption module. The condensate absorption module includes a first piece of cotton, a ceramic atomization core, and a second piece of cotton. The first piece of cotton and the second piece of cotton are disposed on two ends of the ceramic atomization core, respectively. The condensate absorption module of the electronic cigarette further includes an atomizing cylinder and a supporting seat. The ceramic atomization core is disposed in the supporting seat. The ceramic atomization core and the supporting seat are disposed in the atomizing cylinder.

6 Claims, 3 Drawing Sheets

ELECTRONIC CIGARETTE

BACKGROUND

The disclosure relates to an electronic cigarette.

Known electronic cigarettes comprise no anti-condensation device. When encountering cold air, the vapor resulting from the atomization of the e-liquid tends to form condensates, which may block the air channel of the electronic cigarettes.

SUMMARY

The disclosure provides a condensate absorption module comprising a first piece of cotton, a ceramic atomization core, and a second piece of cotton. The first piece of cotton and the second piece of cotton are disposed on two ends of the ceramic atomization core, respectively.

The condensate absorption module further comprises an atomizing cylinder and a supporting seat; the ceramic atomization core is disposed in the supporting seat; and the ceramic atomization core and the supporting seat are disposed in the atomizing cylinder.

The disclosure further provides an electronic cigarette comprising a condensate absorption module, the condensate absorption module comprising a first piece of cotton, a ceramic atomization core, and a second piece of cotton; the first piece of cotton and the second piece of cotton are disposed on two ends of the ceramic atomization core, respectively.

The condensate absorption module of the electronic cigarette further comprises an atomizing cylinder and a supporting seat; the ceramic atomization core is disposed in the supporting seat; and the ceramic atomization core and the supporting seat are disposed in the atomizing cylinder.

The electronic cigarette further comprises an insulation ring, a joint, a shell, a pneumatic switch, and a USB support; the USB support is disposed on a bottom of the shell and comprises a charging port for charging and air intake; the pneumatic switch is disposed in the shell; the insulation ring is disposed on a bottom of the atomizing cylinder and is fixedly connected to the joint; the joint is a hollow structure for conducting and ventilating; and the atomizing cylinder is disposed on a top of the shell.

The electronic cigarette comprises a condensate absorption module. The condensate absorption module comprises the first piece of cotton and the second piece of cotton disposed on two ends of the ceramic atomization core, respectively, to adsorb condensates on the two ends of the ceramic atomization core, respectively, thereby preventing the condensates from blocking the air channel. In addition, the electronic cigarette comprises a straight air channel; the air flow enters the electronic cigarette from the charging port and drives the pneumatic switch to work, then passes through the inner space of the electronic cigarette, and exits from the air channel of the electronic cigarette.

DETAILED DESCRIPTION

To further illustrate, embodiments detailing an electronic cigarette are described below. It should be noted that the following embodiments are intended to describe and not to limit the disclosure.

Figure 1:
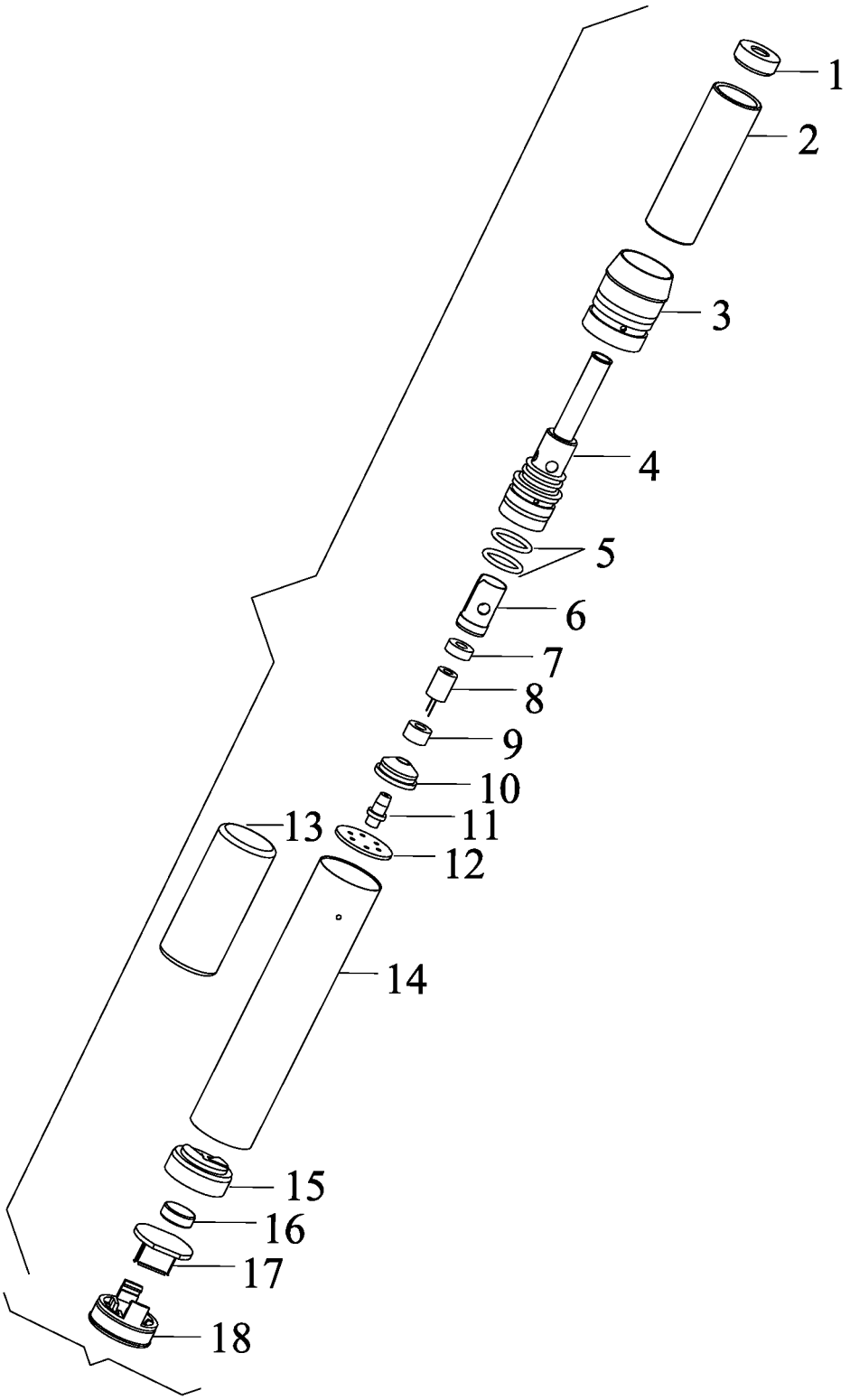
FIG. 1 is an exploded view of an electronic cigarette according to one embodiment of the disclosure.
Figure 2:
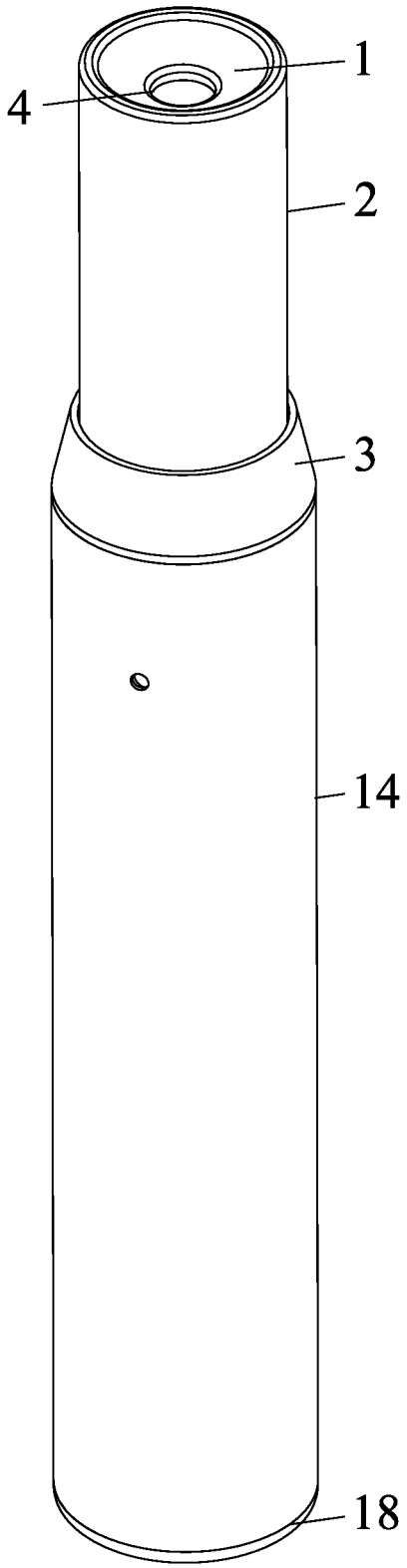
FIG. 2 is a schematic diagram of an electronic cigarette according to one embodiment of the disclosure.
Figure 3:
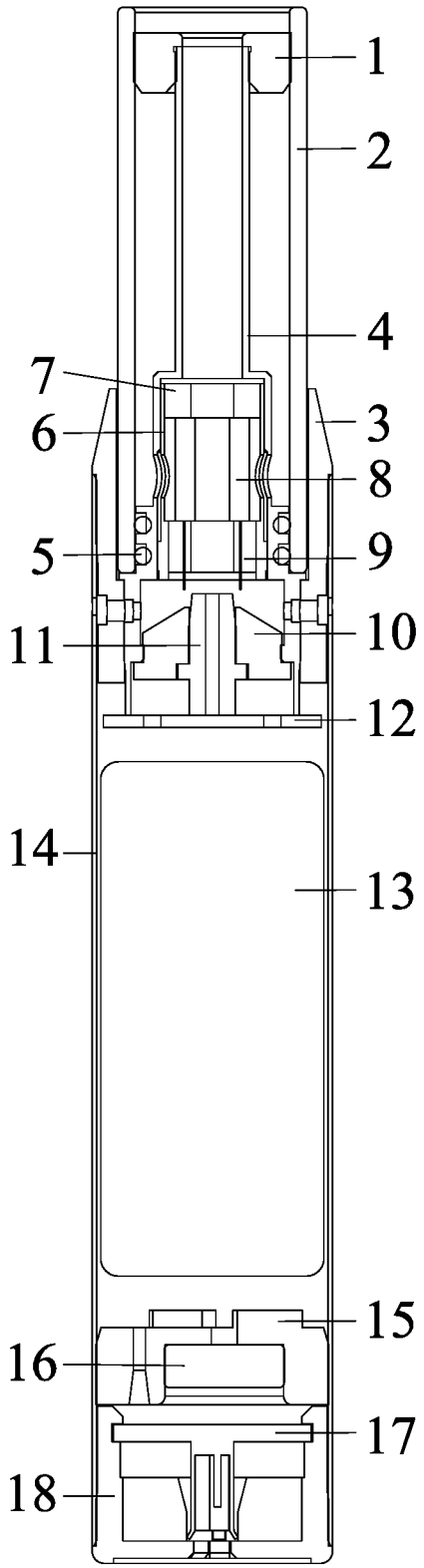
FIG. 3 is a sectional view of an electronic cigarette according to one embodiment of the disclosure.

As shown in FIGS. 1-3, an electronic cigarette comprises a first seal ring 1, a glass tube 2, a connection piece 3, an atomizing cylinder 4, a second seal ring 5, a supporting seat 6 disposed in the atomizing cylinder, a first piece of cotton 7, a ceramic atomization core 8, a second piece of cotton 9, an insulation ring 10, a joint 11, a first silica gasket 12, a battery 13, a shell 14, a second silica gasket 15, a pneumatic switch 16, a USB plate 17, and a USB support 18. The second silica gasket 17 is disposed on the pneumatic switch 16. The USB plate 17 is welded on the pneumatic switch 16. When the air flow passes through the pneumatic switch 16, the pneumatic switch 16 senses the air flow and controls the output of the USB plate 17. The USB plate 17 is disposed on the USB support 18. The USB support 18 is disposed on the bottom of the shell 14. The battery 13 is disposed in the shell 14. The first silica gasket 12 is disposed in the top of the shell 14. The first piece of cotton 7 and the second piece of cotton 9 are disposed on two ends of the ceramic atomization core 8, respectively. The supporting seat 6 is disposed in the atomizing cylinder 4. The insulation ring 10 is disposed in the bottom of the atomizing cylinder 4 to fix the joint 11. The joint 11 is disposed in the insulation ring 10 for conduction and ventilation. The second seal ring 5 is disposed on the atomizing cylinder 4. The atomizing cylinder 4 is disposed on the connection piece 3. The glass tube 2 is disposed on the atomizing cylinder 4. The connection piece 3 is disposed in the top part of the shell 14. The first seal ring 1 is disposed on the top part of the glass tube 2.

The following advantages are associated with the electronic cigarette of the disclosure.

1. The first piece of cotton and the second piece of cotton are disposed on two ends of the ceramic atomization core, respectively, to adsorb condensates on the two ends of the ceramic atomization core, respectively, thereby preventing the condensates from blocking the air channel.

2. The air channel of the electronic cigarette is straight, so that the air flow enters the electronic cigarette from the bottom of the shell and drives the pneumatic switch to work, then passes through the air channel, and exits from the top of the electronic cigarette.

It will be obvious to those skilled in the art that changes and modifications may be made, and therefore, the aim in the appended claims is to cover all such changes and modifications.

What is claimed is:

1. A device, comprising: a first piece of cotton, a ceramic atomization core, an insulation ring, and a second piece of cotton;

wherein:

the ceramic atomization core is in a cylindrical shape and comprises a top surface and a bottom surface;

the first piece of cotton and the second piece of cotton are disposed on the top surface and the bottom surface, respectively;

the insulation ring comprises a top portion, and the top portion is in a conical shape; and the second piece of cotton is disposed on the insulation ring such that the top portion faces the second piece of cotton.

2. The device of claim 1, wherein the device further comprises an atomizing cylinder and a supporting seat; the ceramic atomization core is disposed in the supporting seat; and the ceramic atomization core and the supporting seat are disposed in the atomizing cylinder.

3. An electronic cigarette, comprising a device, the device comprising a first piece of cotton, a ceramic atomization core, an insulation ring, and a second piece of cotton; wherein the ceramic atomization core is in a cylindrical shape and comprises a top surface and a bottom surface; the first piece of cotton and the second piece of cotton are disposed on the top surface and the bottom surface, respectively; the insulation ring comprises a top portion, and the top portion is in a conical shape; and the second piece of cotton is disposed on the insulation ring such that the top portion faces the second piece of cotton.

4. The electronic cigarette of claim 3, wherein the device further comprises an atomizing cylinder and a supporting seat; the ceramic atomization core is disposed in the supporting seat; and the ceramic atomization core and the supporting seat are disposed in the atomizing cylinder.

5. The electronic cigarette of claim 4, wherein the electronic cigarette further comprises a joint, a shell, a pneumatic switch, and a USB support; the USB support is disposed on a bottom of the shell; the pneumatic switch is disposed in the shell; the insulation ring is disposed on a bottom of the atomizing cylinder and is fixedly connected to the joint; the joint is a hollow structure for conducting and ventilating; and the atomizing cylinder is disposed on a top of the shell.

6. The electronic cigarette of claim 5, wherein the electronic cigarette comprises a straight air channel.

* * * * *